United States Patent [19]

Noda et al.

[11] 4,353,981

[45] Oct. 12, 1982

[54] SILVER HALIDE PHOTOGRAPHIC MATERIAL

[75] Inventors: Tōru Noda, Tokyo; Yoshinobu Ichihashi, Kitakami; Massashi Kubbota, Tokyo, all of Japan

[73] Assignee: Mitsubishi Paper Mills, Ltd., Tokyo, Japan

[21] Appl. No.: 184,619

[22] Filed: Sep. 5, 1980

[30] Foreign Application Priority Data

Sep. 12, 1979 [JP] Japan ..... 54/116912
Oct. 9, 1979 [JP] Japan ..... 54/130426

[51] Int. Cl.[3] ..... G03C 1/86

[52] U.S. Cl. ..... 430/536; 430/538; 430/605; 430/608; 162/78; 162/80; 162/157 C; 162/182

[58] Field of Search ..... 430/536, 538, 605, 608; 162/78, 80, 182, 157 C

[56] References Cited

U.S. PATENT DOCUMENTS 3,100,732 8/1963 Smedberg ..... 162/78
3,284,283 11/1966 Kindron et al. ..... 162/80
3,582,337 6/1971 Griggs et al. ..... 430/538
3,865,685 2/1975 Hebbel et al. ..... 162/78
3,885,962 5/1975 MacClaren ..... 430/538
3,901,711 8/1975 Iwaosa et al. ..... 430/608

*Primary Examiner*—J. Travis Brown
*Attorney, Agent, or Firm*—Cushman, Darby & Cushman

[57] ABSTRACT

A silver halides photographic material with improved keeping quality, said material having a substrate formed by coating a base web with a film-forming resin, preferably a polyolefin resin, said base web being composed principally of natural pulp or a mixture of two or more different types of natural pulp having a post color number of 2 or below, said post color number being defined by the following formula:

$$P = 100 \times \left\{ \frac{(1-R)^2}{2R} - \frac{(1-Ro)^2}{2Ro} \right\}$$

[wherein Ro is brightness (%)×(1)/(100) before fading treatment, R is brightness (%)×(1)/(100) after 18-hour fading treatment at 85° C. and 95% RH, and P is post color (PC) number which indicates the degree (nondimensional number) of fading].

11 Claims, No Drawings

SILVER HALIDE PHOTOGRAPHIC MATERIAL

This invention relates to a silver halides photographic material and more particularly it relates to the improvement of keeping quality or shelf life of the silver halides photographic material having a substrate formed by coating a base web mainly composed of natural pulp with a film-forming resin, preferably a polyolefin resin (said substrate being hereinafter referred to as resin-coated web). More specifically, the invention relates to the improvement of keeping quality of the silver halides photographic material comprising a resin-coated web having laid thereon a silver halides photographic emulsion layer or layers produced by containing at least one of the water-soluble rhodium compounds, water-soluble iridium compounds and water-soluble gold compounds in the emulsion in the course of production of the silver halides photographic emulsion.

Baryta paper has long been used as photographic material substrate, but recently it is being superseded by the resin-coated web formed by coating the base web principally composed of natural pulp with a film-forming resin, mostly a polyolefin resin. This is attributable to the advantage of the resin-coated web in that it allows sizable reduction of the treating time for such treatments as water-washing, drying, etc., as the treating solution can not easily infiltrate the base web layer during the developing and fixing treatments of the silver halides photographic materials as compared with the case of using baryta paper as substrate because the resin-coated web is hydrophobic.

Generally, when the silver halides photographic material is kept in storage, particularly under a high-temperature condition, after its production, there arises a tendency for change in the photographic properties such as tone, sensitivity, etc., of the photographic material as the time of storage is prolonged, resulting in too soft tone or unduly high or low sensitivity. There might also take place so-called "fogging", or a phenomenon that the unexposed portion of the photographic material becomes developable in the developing treatment.

In order to prevent such undesirable changes of photographic properties, many attampts have been made hitherto for improving the keeping quality of the silver halides photographic material, and one typical method for such improvement is to contain a compound referred to as stabilizer in a constitutional layer of the photographic material. Generally, however, use of such stabilizer tends to bring about certain adverse effect such as lowering of sensitivity of the silver halides photographic material, softening of tone, drop of density, deterioration of developability, latent image stability, fixing quality and bleaching stability of the color photographic material using silver halides. Particularly, use of a stabilizer in a multilayer silver halides color photographic material having, for example, a blue-sensitive emulsion layer, a green-sensitive emulsion layer and a red-sensitive emulsion layer may even more amplify the ill effects of the stabilizers to the bottommost emulsion layer which adjoins the substrate. There have been proposed the hydroxy substituted triazolopyrimidine compounds and mercaptotriazole compounds having the acylamino groups as the stabilizers with reduced adverse effect or as antifogging agent. Also, the degraded products of nucleic acids and dihydroxybenzene compounds have been proposed as the agents to the improvement for keeping quality of the silver halides photographic emulsions produced by incorporating a water-soluble rhodium compound at the time of formation and dispersion or at the time of physical ageing of the silver halides particles. However, even if such stabilizer or antifogging agent is contained in a photographic material forming layer provided on the resin-coated web formed by coating the base web principally composed of natural pulp with a film-forming resin, there would still be induced not a few bad influences, and no satisfactory effect could be obtained for storage stability, particularly for keeping of tone and sensitivity. Especially, in case of introducing into the emulsion at least one of the water-soluble rhodium compounds and water-soluble iridium compounds at the time of formation and dispersion or at the time of physical aging of the silver halides for obtaining the hard photographic characteristics or other sort of improved photographic properties, or in case of containing a water-soluble gold compound in the emulsion for obtaining high sensitivity, the keeping quality of the silver halides photographic material using a film-formable resin-coated web as substrate would be even worsened, and incorporation of said stabilizing compounds could not provide a satisfactory improving effect for the keeping quality of said photographic material, particularly for keeping of tone and sensitivity.

Japanese Patent Application Kokai (Laid-Open) No. 102330/1974 proposed a substrate containing a hydroxy substituted triazolopyrimidine in the polyolefin resin layer for the purpose of preventing fogging without affecting the properties of the silver halides photographic emulsion, but this proposal was unsatisfactory for eliminating the adverse effects of the stabilizer and also quite ineffective in providing the keeping quality to the silver halides photographic material having said substrate. Regarding photographic paper, Japanese Patent Application Kokai (Laid-Open) No. 65423/1977 proposed a device for removing the ill effects to the photographic properties by the cationic high-molecular electrolyte, but the keeping quality of the silver halides photographic material using as substrate a resin-coated web comprising said base web was very poor.

As viewed above, there is not yet known any means capable of satisfactorily improving the keeping quality, particularly retainability of tone and sensitivity, of the silver halides photographic material using a resin-coated web as substrate, without adversely affecting other photographic properties. Concerning such keeping quality, particularly that for tone and sensitivity, of the silver halides photographic material using said resin-coated web as substrate, the difficulty for improvement resides in the fact that the complicate factors of both the resin-coated web and the silver halides photographic emulsion layer(s) are intertwined with each other. It has been generally considered hitherto that, in the case of resin-coated web, there is less possibility of giving an influence to the silver halides photographic emulsion layer having provided on the resin-coated web a base paper mainly composed of natural pulp, because there is provided a resin layer which is chemically inert and has the excellent barrier properties.

It was however clarified, as a result of more extensive studies by the present inventors, that the base paper mainly constituted from natural pulp gives banefical effect to the keeping quality of the silver halides photographic emulsion layer provided on the resin-coated web formed from said base web. More specifically, it was disclosed that in combination of the base paper principally composed of natural pulp and a specific silver halides emulsion layer provided on the resin-coated web formed from said base web, namely, an emulsion layer produced by incorporating at least one of the water-soluble rhodium compounds and water-soluble iridium compounds at the time of formation and dispersion or at the time of physical agening of the silver halides, or an emulsion layer produced by containing a water-soluble gold compound, the keeping quality of said emulsion layer, particularly the keeping quality for tone and sensitivity, is markedly worsened, and the present invention was reached on the basis of such findings. It was a surprise that the photographic material made by providing a silver halides emulsion layer on such base as baryta paper, polyester film or polystyrene paper ("Printel" a trade name: manufactured by Sekisui Chemical Co., Ltd.) instead of providing the same silver halides emulsion layer on a resin-coated web is not so bad in keeping quality, and quite a satisfactory result is obtained by using a heretofore known type of stabilizer. Especially, it was much surprising to note that as compared with the silver halides photographic material using a resin-coated web as substrate, the one using baryta paper as substrate, which is just same as the first-said material in that it uses a base web principally composed of natural pulp, is far superior in keeping quality.

The first object of this invention, therefore, is to provide a silver halides photographic material using as substrate a resin-coated web which has been improved in keeping quality, allowing retention of the photographic characteristics such as sensitivity, tone, etc., during storage without causing any adverse effect photographically. Secondarily, the invention is intended to provide a silver halides photographic material using as substrate a resin-coated web which has been improved in keeping quality and which shows the improved photographic characteristics relating to hard tone and other respects without causing any adverse photographic effect, said photographic material having an emulsion layer produced by incorporating at least one of the water-soluble iridium compounds and water-soluble rhodium compounds at the time of formation and dispersion or at the time of physical ageing of silver halides. Thirdly, the invention provides a silver halides photographic material using as substrate a high-sensitivity resin-coated web which has been improved in keeping quality without inducing any undesirable photographic influence, said photographic material having an emulsion layer containing a water-soluble gold compound. Still another object of this invention is to provide a substrate which is suppressed in its aptness to fogging so as to enable reduction or elimination of the antifogging agent or stabilizer to be contained in the silver halides emulsion layer, thereby making it possible to produce a silver halides photographic material having the favorable photographic characteristics as well as the excellent practical properties such as excellent development expediting property, latent image stability, fixing property, bleaching stability, etc.

As a result of a close study by the present inventors, it was found that the objects of this invention can be accomplished by providing a silver halides photographic material using as substrate a resin-coated web formed by coating a base web with a film-forming resin, said base web being principally constituted from natural pulp or a mixture of two or more different types of natural pulp having a post color (PC) number of 2.0 or below. The PC number is one means for expressing the fading disposition of natural pulp, and it is determined from the brightness degrees before and after the heat aging test. Actually, the PC number is given by the following formula:

$$PC \text{ number} = 100 \times \left\{ \frac{(1-R)^2}{2R} - \frac{(1-Ro)^2}{2Ro} \right\}$$

wherein R and Ro are the light reflectance or brightness (%) of natural pulp at the wavelength of 4,570 A after and before fading, respectively, with said brightness (%) being multiplied by (1)/(100). In this invention, the PC number was calculated by measuring brightness of the pulp before and after fading according to JIS (Japanese Industrial Standard) P-8123 "Hunter's brightness testing method for paper and pulp". The heat aging test of pulp was carried out in a 85° C., 95% RH thermohygrostat for a period of 18 hours.

As natural pulp used in practicing this invention, there may be advantageously employed wood pulp such as conifer pulp, hardwood pulp or mixture thereof. It is also possible to use kraft pulp, sulfite pulp, soda pulp, etc., and as digesting aid, there may be used various types of pulp using the anthraquinone compounds. It is to be noted that the pulp material used in this invention needs to have a PC number of less than 2.0, preferably less than 1.5. However, in case of using a mixture of two or more different types of natural pulp, it is only required that the PC number of the mixture is less than 2.0, particularly less than 1.5, and it is free to use a pulp with a PC number of greater than 2.0 as a part of the mixture of two or more different types of natural pulp.

As means for preparation or treatment of natural pulp, preferably wood pulp with a PC number of less than 2.0 used in this invention, there may be cited, for example, a bleaching treatment in which natural pulp is first digested, then subjected to at least a chlorine treatment, an alkali treatment or an extraction and hypochlorite bleaching treatment and then further bleach treated with a peroxide in an alkaline aqueous medium in a reactor or reaction tower, or with a boron hydride compound in an alkaline aqueous medium in a reaction vessel or reaction tower.

For practicing the alkaline bleaching treatment with a peroxide in this invention, there may be employed any available system in which a peroxide is acted to or reacted with natural pulp in an alkaline state, for example a system in which an alkaline peroxide solution is applied or sprayed to a travelling pulp sheet, or a system in which natural pulp is bleached by using a peroxide in an alkaline aqueous medium in a reaction vessel or a reaction tower. The effect of this invention is most prominent in case the bleaching treatment is carried out in an alkaline aqueous medium in a reaction vessel or a reaction tower.

In order to further suppress the fogging tendency and also to further improve the keeping quality of the silver halides photographic material according to this invention, said peroxide or boron hydride compound bleaching treatment in an alkaline aqueous medium is preferably performed after completing pulp digestion, chlorine or alkali treatment, extraction or refining treatment, hypochlorite bleaching, chlorine dioxide bleaching or combined multi-stage bleaching treatment, and more preferably said peroxide or boron hydride treatment is carried out as the final bleaching step after the conventional pulp bleaching treatment. Also, the effect of this invention can be produced eminently by further repeating the alkali treatment or the extraction or refining treatment. Among the multistage natural pulp bleaching treatment systems that can be advantageously employed in practicing the present invention, it is advantageous to employ a system comprising a chlorine treating step (hereinafter referred to as the symbol C) as the first stage, an alkali treatment or extraction step (hereinafter referred to as the symbol E) as the second stage, a hypochlorite bleaching step (hereinafter referred to as the symbol H) or chlorine dioxide bleaching step (hereinafter referred to as the symbol D) as the third stage, and a peroxide bleaching step (hereinafter referred to as the symbol P) in an alkaline aqueous medium or boron hydride compound bleaching step (hereinafter referred to as the symbol B) as the fourth and ensuring stages. For instance, in the case of sulfite pulp, it is advantageous to employ the "CEHP", "CEHDP" or "CEHDB" system, and in the case of kraft pulp, it is advantageous to employ the "CEHDP", "CEHDEDP", "CEDEDP", "CEHDEDB" or "CEDEDB" system.

As for bleaching chemicals for natural pulp according to this invention, chlorine gas or chlorine water is used for chlorine bleaching while sodium hydroxide may be favorably used for alkali treatment or extraction, but it is also possible to use calcium hydroxide, ammonia and mixtures thereof. For hypochlorite bleaching, there may be advantageously employed a bleaching powder produced by acting solid and powdery slaked lime to chlorine or a hydrochlorite bleaching liquor, such as calcium-bleaching liquor or sodium-hypo-bleaching liquor, prepared by blowing chlorine into milk of lime or a dilute sodium hydroxide solution, such bleaching liquor being advantageous for industrial use. For chlorine dioxide bleaching, one may favorably use chlorine dioxide prepared according to a sulfurous acid process such as Mathieson process, New-Mathieson process, Erst process, C.I.P. process, etc., or a hydrochloric acid process such as Kesting process, Nisso process, Solvay process, etc.

For the bleaching treatment performed by using a peroxide in an alkaline condition, there may be used, for example, hydrogen peroxide, sodium peroxide, peroxide bleaching liquor (mixed solution of hydrogen peroxide, sodium peroxide and, if necessary, magnesium sulfate), etc., as inorganic peroxide; peracetic acid, t-butylhydroperoxide, their mixture, etc., as organic peroxide; and alkali hydroxides such as NaOH, KOH, $NH_4OH$, $Mg(OH)_2$, etc., alkaline earth hydroxides such as calcium hydroxide, their mixture, etc., as alkali. Sodium boron hydride is preferred for boron hydride compound bleaching.

The bleaching treatment of natural pulp according to this invention can be accomplished under the various conditions such as, for example, shown in "Pulp Treatments and Bleaching" complied by the Association of Paper and Pulp Technology. For instance, the bleaching treatment of wood kraft pulp according to the "C-E-H-D-E-D" system can be performed under the conditions shown in the following table.

| | Conditions | | | | |
|---|---|---|---|---|---|
| Stage | Added amount of chemicals (% by wt./wt of pulp absolutely dried) | Pulp concentration (%) | Temperature (°C.) | Time (min.) | pH |
| C | 2–6 | 2–5 | Normal temp.–70 | 15–75 | 1–2.5 |
| E | 1–5 | 9–15 | 50–70 | 30–75 | 8–11 |
| H | 0.8–5 | 5–15 | 35–70 | 40–180 | 6–10 |
| D | 0.2–0.6 | 9–15 | 60–80 | 120–300 | 4–6 |
| E | 0.2–1.5 | 9–15 | 30–70 | 30–75 | 8–11 |
| D | 0.1–0.6 | 9–15 | 60–80 | 120–300 | 4–6 |

Amount of chemicals added in the stage H is the effective amount of chlorine.

In the peroxide bleaching treatment under an alkaline condition according to this invention, the amount of the peroxide used is 0.02–10%, preferably 0.08–2% of natural pulp based on absolute dry weight%, and the amount of the alkali used is 0.03–6%, preferably 0.1–3% of natural pulp based on absolute dry weight. Also, in the peroxide bleaching treatment in an alkaline aqueous medium which is most advantageous for the practice of this invention, the pulp concentration in the pulp suspension is higher than 2%, preferably 8–16%, and the reaction temperature is from 35° C. to the boiling point of the pulp suspension whilst the reaction time is between 15 minutes and 3 hours.

The preferred conditions for the natural pulp bleaching treatment conducted by using a peroxide in an alkaline aqueous medium and for the bleaching treatment conducted by using a boron hydride compound in an alkaline aqueous medium according to this invention are as shown in the following table.

| | Conditions | | | | | |
|---|---|---|---|---|---|---|
| Stage | Added amount of chemicals (% by wt./wt. of absolutely dried pulp) | | Pulp concentration (%) | Temperature (°C.) | Time (min.) | pH |
| P | Peroxide | 0.08–2 | 8–16 | 50–80 | 15–180 | 8–11 |
| | Alkali | 0.1–3 | | | | |
| B | Boron hydride compound | 0.08–1 | 2–12 | 30–80 | 15–120 | 8–11 |
| | Alkali | 0–3 | | | | |

The peroxide-using bleaching treatment in an alkaline aqueous medium is advantageously carried out in the presence of a stabilizer, for example an organic acid such as ethylenediamine-tetraacetic acid, diethylenetriaminepentaacetic acid, etc., or a salt thereof, a magnesium salt such as magnesium chloride, magnesium silicate, magnesium sulfate, magnesium oxide, etc., or a calcium salt such as calcium chloride, calcium carbonate, calcium silicate, etc.

In preparation of the base web principally composed of natural pulp, which is used in practicing this invention, it is recommended to incorporate various kinds of additives including, for example, a dry paper strength booster such as cationized starch, cationized polyacrylamide, anionized polyacrylamide, carboxy-modified polyvinyl alcohol, etc., a sizing agent such as fatty acid salts, rosin, rosin derivatives such as maleated rosin, dialkylketene dimer emulsion, etc., a filler such as clay, kaolin, calcium carbonate, barium sulfate, titanium oxide, aluminum hydroxide, magnesium hydroxide, etc., a wet paper strength booster such as melamine resin, urea resin, epoxidized polyamide resin, etc., a fixing agent including polyvalent metal salts such as aluminum sulfate, aluminum chloride, etc., cationic polymers such as cationized starch, etc., and a pH adjustor such as sodium hydroxide, sodium carbonate, etc. It is also advantageous to blend a dye, fluorescent whitening agent and the like in suitable combinations. For preparation of the sheet, there may be employed a manual paper machine or other commonly used types of paper machine such as wire paper machine or cylinder paper machine.

The base web principally composed of natural pulp according to this invention is preferably subjected to tub sizing or size-pressing with a solution containing various kinds of water-soluble high-molecular substances and/or additives. Among the water-soluble high-molecular substances usable for said purpose are, for example, cationized starch, polyvinyl alcohol, carboxy-modified polyvinyl alcohol, carboxymethyl cellulose, hydroxyethyl cellulose, cellulose sulfate, gelatin, casein, sodium polyacrylate, sodium salt of styrene-maleic anhydride copolymers, sodium polystyrenesulfonate, etc. As additives, there may be cited sizing agents such as petroleum resin emulsions, ammonium salts of styrene-maleic anhydride copolymer alkyl esters, alkylketene dimer emulsions, other types of emulsions and latices such as styrene-butadiene copolymer, ethylene-vinyl acetate copolymer, polyethylene, vinilydene chloride copolymer, etc.; inorganic electrolytes such as common salt, Glauber's salt, etc.; hygroscopic materials such as glycerin, polyethylene glycol, etc.; pigments such as clay, kaolin, talc, barium sulfate, titanium oxide, etc.; pH adjustors such as hydrochloric acid, sodium hydroxide, sodium carbonate, etc.; dyes, fluorescent whitening agents and the like. It is advantageous to use these additives in combination.

No specific restriction is imposed on the type and thickness of the base web used in this invention, but it is desirable to use a web having a flat and smooth surface worked by, for example, compressing the web by a calender. Such base web preferably weighs 50 to 250 $g/m^2$.

As for the film-forming resin used in this invention, it is advantageous to employ homopolymers of $\alpha$-olefins such as ethylene, propylene, etc., copolymers consisting of two or more $\alpha$-olefins such as ethylene, propylene, etc., copolymers of $\alpha$-olefins (main component) and other monomers copolymerizable therewith, and mixtures thereof. It is also possible to blend in the resin a white pigment such as titanium oxide, zinc oxide, talc, calcium carbonate, alumina, etc., a fibrous filler such as glass fiber, asbestos, whisker, etc., a color pigment such as carbon black, phthalocyanine pigment, chrome yellow, titanium yellow, red oxide, ultramarine blue, etc., and other usually used types of additives including stabilizer, antioxidant, antistatic, plasticizer, dispersing agent, lubricant, fluorescent agent, etc.

The resin-coated web used in this invention is usually produced according to a so-called extrusion coating method in which the heated and molten resin is cast onto the base web, and both sides of the web are coated with the resin. Preferably, the base web is subjected to an activating treatment such as corona discharge treatment or flame treatment before coating the resin. The emulsion side of the resin-coated web may have a glossy surface, mat surface, silky surface, etc., according to the purpose of use, while the rear side has usually a non-glossy surface. The front side, and if necessary both front and rear sides, may be subjected to an activating treatment such as corona discharge treatment or flame treatment. The thickness of the resin layer on the resin-coated web is not subject to any specific restriction, but it is usually advantageous to form a resin layer thickness of approximately 5 to 50 microns by extrusion coating.

As the water-soluble rhodium compound used in this invention, there may be cited rhodium dichloride, rhodium trichloride, rhodium hexahalogenide and the like. The optimum amount of such compound added for obtaining a hard-tone silver halides photographic emulsion by incorporating said compound at the time of formation and dispersion or at the time of physical aging of silver halides is within the range of $10^{-9}$ to $10^{-5}$ moles to one mole of silver halides.

The water-soluble iridium compounds usable in this invention include the hexahalogeno complex salts such as iridium (III) hexahalogenide, iridium (IV) hexahalogenide, etc., and iridium halides such as iridium (III) chloride, iridium (IV) chloride, iridium (III) bromide, iridium (IV) bromide, etc. The optimum amount of such compound added for obtaining a hard-tone silver halides photographic emulsion with the improved photographic properties by incorporating said compound at the time of formation and dispersion or at the time of physical aging of silver halides is within the range of $10^{-8}$ to $10^{-4}$ moles to one mole of silver halides. It is already known that the silver halides photographic emulsions having the hard tone and other different improved photographic properties can be obtained by incorporating a water-soluble iridium compound at the time of formation and dispersion or at the time of physical aging of silver halides, and for example Japanese Pat. No. 4933/1968 and Japanese Pat. No. 33781/1974 describe preparation of the hard tone silver halides emulsions with the improved flash exposure characteristics. Also, Japanese Patent Application Kokai (Laid-Open) No. 6725/1973 discusses about improvement of latent image stability of the silver halides photographic material and Japanese Patent Kokai (Laid-Open) No. 107129/1976 proposed a means for reducing the tendency to stress fogging of the silver halides photographic material. Further, Japanese Patent Application Kokai (Laid-Open) No. 65432/1977 shows a proposal for controlling peculiar spot-like non-uniformity of the silver halides photographic material and Japanese Patent Kokai (Laid-Open) No. 88340/1977 teaches an improvement of humidity dependency of the silver halides color photographic material.

As examples of the water-soluble gold compounds usable in this invention, there may be cited gold halides such as aurous chloride, auric chloride, aurous iodide, auric iodide, etc., aurates such as potassium aurite, potassium aurate, etc., halogeno gold acids such as chloro aurous acid, chloro auric acid, bromo aurous acid, bromo auric acid, etc., halogeno gold acid salts such as aurous potassium chloroaurite potassium chloroaurate, sodium chloroaurate, potassium bromoaurite, potassium bromoaurate, sodium bromoaurate, etc., potassium auric cyanide, potassium auric rhodanide, ethylenediamine-bis-gold chloride, organic gold sensitizers, etc. For incorporating such water-soluble gold compound in the silver halide photographic emulsion layer, said compound may be added in the emulsion at the time of formation and dispersion or at the time of physical aging of silver halides, or before, during or after chemical aging (second-stage aging) of the silver halides photographic emulsion.

The effects of this invention, such as improvement of keeping quality, suppression of fogging tendency, creation of the excellent photographic properties, are manifested most prominently in case the silver halides photographic emulsion of this invention is sensitized. No particular definition is given to the sensitization method usable with this invention.

For example, the emulsion may be sensitized by various chemical sensitization methods, for example, a sulfur sensitization method using a sensitization type gelatin including an active sulfur compound, a thiosulfate, an active sulfur compound or such, a seleno sensitization method using a seleno compound such as H,H-dimethylselenourea, a method in which a water-soluble noble metal compound such as palladium, ruthenium, osmium, platinum, etc., is added at the time of chemical or physical aging, or a method using a quaternary ammonium salt, thioether compound, polyethylene oxide derivative, diketone or the like.

These chemical sensitization methods may be used not only singly but also in combination.

Also, the polymethine dyes such as cyanine, merocyanine, carbocyanine, etc., may be used either singly or in combination, or these dyes may be used in combination with styryl dyes to effect spectral sensitization or strong-color sensitization along with chemical sensitization. It is also possible to sensitize the emulsion by using an ultrasensitizing additive which does not absorb visible light such as organic sulfonic acid or ascorbic acid derivatives.

The present invention also finds its application to the color photographic emulsions, that is, the emulsions added with a compound (coupler) which forms a dye upon reaction with the oxidation product of the developer. As typical examples of the couplers usable for this purpose, there may be cited the pivaloylacetoanilide type or benzoylacetoanilide type openchain ketomethylene yellow couplers, pyrazolone type or imidazolone type magenta couplers and phenol type or naphthol type cyan couplers. There may be also used the azo type colored couplers, development inhibitor releasing type couplers (DIR couplers) and two-equivalent couplers involving at the active point thereof -Q-aryl substitution, -Q-acyl substitution, hydantion compound substitution, urazol compound substitution, pyridazone compound substitution or halogen atom substitution, these couplers being adapted for effecting auto-masking in conformity to the structure of the above-said couplers.

The effects of this invention manifest themselves regardless of the composition (including silver chloride, silver bromide, silver chloro-bromide, silver iodo-bromide, silver chloro-iodo-bromide, etc.) of the silver halides, crystal form or habit thereof, silver ion concentration in the emulsion, pH in the emulsion and the type of the silver halide particle binder.

Also, no specific restrictions are imposed on the formulation, dispersion and primary aging of the silver halides photographic emulsions for which preparation the present invention is applicable. In other words, this invention is applicable to the emulsions prepared according to a variety of known methods including, for example, a normal mixing method, a reverse mixing method, a simultaneous mixing method (double jet method and multi-jet method), a transformed silver halides method such as shown in Japanese Pat. No. 7772/1971 or U.S. Pat. No. 2,592,520, an ammonia method, an acid or neutral method, an alkali method, an ethylene-diamine method shown in U.S. Pat. No. 2,448,534, a silver iodide nucleus method shown in Japanese Patent Kokai (Laid-Open) No. 65925/1973 and combinations of these methods. The invention is also effective for the emulsions incorporated with various kinds of additives at the time of formulation and dispersion or after primary aging of the silver halide emulsion and the emulsions incorporated with the inorganic or organic metal salts such as mercaptoheterocyclic compound, hydroxy-triazopyrimidine compounds, water-soluble zinc, lithium, nickel, etc., and combinations thereof. The present invention finds best application to the emulsions which have undergone precipitation and dehydration after primary aging and then water washing till a desired electric conductivity and silver ion concentration have been reached, but it is also appliable to the emulsions which have undergone no water washing.

Also, no particular limitations are placed on the binder and protective colloid used for the preparation of the silver halides photographic emulsions of this invention. Thus, it is possible to use various types of synthetic hydrophilic binder compositions and the derivatives thereof including, for example, lime-treated gelatin, acid-treated gelatin, gelatin derivatives such as phthalated gelatin or acylated gelatin, protein such as albumin or casein, cellulose compounds such as carboxymethylcellulose or hydroxyethyl cellulose, starch and its derivatives, polyvinyl alcohol, poly-N-vinylpyrrolidone, polyacrylic acid copolymers, polyacrylamide, etc., and as thickener for such gelatin and gelatin derivatives, there may be used natural or synthetic high-molecular substances having the hydroxyl groups such as cellulose, dextran, dextrin, alginic acid, starch, polyvinyl alcohol, etc., preferably the sulfuric acid ester compounds of polysaccharide, styrene-maleic acid copolymers, alkyl vinyl ether-maleic acid copolymers and other like polymers, all of these substances being usable either singly or in combination.

This invention is also applicable to the emulsions containing various kinds of additives in the constitutional layers. The additives include antifogging agent or stabilizer such as hydroxytriazopyrimidine compounds as exemplified in U.S. Pat. Nos. 2,716,062 and 2,944,900, mercapto-heterocyclic compounds, 2-thionheterocyclic compounds and other heterocyclic compounds having no mercapto groups such as benzimidazole, benztriazole, 1-phenyl-tetrazole, benzoxazole and guanazole compounds as mentioned or exemplified in Japanese patent application Kokai (Laid-Open) Nos. 102621/1973 and 107129/1976; hardeners including the organic hardeners such as formalin, halogenocarboxylic acid, vinyl sulfone compounds, aziridine compounds, acryloyl compounds, isocyanate compounds, etc., and inorganic hardeners such as chromium alum, zirconium carbonate, etc.; surfactants including anionic surfactants such as alkylbenzenesulfonates, sulfosuccinic acid ester salts, etc., nonionic surfactants such as saponin, alkylene oxide surfactants, etc., and ampholytic surfactants such as amino acids, aminosulfonic acids, amino alcohol esters, etc.; anti-contamination agents or color antifogging agents such as hydroquinone compounds having two or more alkyl groups with four or more carbon atoms, pyrazolone-5 white coupler compounds, etc.; ultraviolet absorbers such as benzotriazole compounds having a hydroxy-di-alkylphenyl group at the 2-position; fluorescent whitening agents such as the compounds shown in Japanese Patent Publication No. 24068/1970, Japanese Patent Kokai (Laid-Open) No.

94318/1979, etc.; sharpness improving dyes such as Amaranth and acidic dyes such as exemplified in Japanese Patent Kokai (Laid-Open) No. 14721/1972, etc.; development accelerators such as allyl alcohol compounds; chelating agents such as ethylenediaminetetraacetic acid; mordants such as N-guanylhydrazone compounds, quaternary onium salt compounds, tertiary amine compounds, etc.; and antistatic agent such as diacetyl cellulose, styrene-perfluoroalkylene sodium maleate copolymers, alkali salts of the reaction products of styrene-maleic anhydride copolymers and p-aminobenzenesulfonic acid, etc. The present invention is also applicable to the emulsions containing, as matting agent, methyl polymethacrylate, polystyrene, methacrylic acid-methacrylate copolymers, colloidal silicon oxide, etc., and, as film property improver, acrylic acid esters, latices composed of the copolymers of vinyl esters and other monomers having ethylene groups, etc. In case these compounds are hydrophobic, they may be contained in the emulsion layers by an oil protection method or a resin latex method.

For providing the silver halides emulsion constitutional layer on the substrate of this invention, there may be employed various known systems such as Dip system, Meniscus system, Air knife system, Slidehopper system, Extrusion bar system, curtain flow system or a combination thereof, followed by drying.

The silver halides photographic material according to this invention can be subjected to the treatments such as exposure, stop of development, fixing, bleaching, stabilization, etc., in the manner such as described in "Photographic Sensitive Materials and Their Handling" (in Japanese) (Goro Miyamoto: Lectures on Photographic Techniques II, published from Kyoritsu Shuppan, Co.) in conformity to the sensitive material employed. Particularly, in the case of the multi-layer silver halides color photographic materials which are subjected to a one-bath bleaching and fixing treatment after color development, it is possible to treat them with a color developer of any base such as CD-III (Eastman Kodak Co.), CD-IV (Eastman Kodak Co.), Droxychrom (May and Baker Chemical Co.), etc. A development accelerator such as phenidone, hydroxyquinone, thallium salt, etc., may be contained in the developer comprising such base. The one-bath bleaching and fixing solution used here is preferably a solution containing a metal salt of aminopolycarboxylic acid (for example a ferric complex salt or cupric complex salt such as ethylenediaminetetraacetic acid, propylenediaminetetraacetic acid, etc.). As fixing agent, it is recommended to use ammonium thiosulfate, sodium thiosulfate or the like. Such one-bath bleaching and fixing solution may be blended with various kinds of additives including, for example, a desilver accelerator (such as mercaptocarboxylic acid, aminomercapto-heterocyclic compounds, onium compounds, etc.), an anti-contamination agent (such as phenidone, Metol, CD-III, ascorbic acid, hydroxylamine hydrochloride, etc.), a pH controlling agent or pH buffer, a hardener (such as magnesium sulfate, aluminum sulfate, alum, etc.), a fluorescent whitening agent, a surfactant and other various kinds of compounds in a variety of combinations. Such one-bath bleaching and fixing solution may be used in a wide pH range, but the most preferred pH range is 6.0–7.5.

In order to describe the present invention in further particular, there are shown hereinbelow the embodying examples of the invention.

EXAMPLE 1

Paper was made by using the following conifer kraft pulp.

Pulp 1. Conifer kraft pulp which has undergone the "CEHDED" bleaching treatment under the conditions described on page 14 of the text of this specification. The PC number of this pulp as defined in the text of this specification was 3.7 (All of the PC numbers appearing hereinafter are as defined in the text of the specification).

Pulp 2. Conifer kraft pulp with a PC number of 1.3 obtained by further subjecting pulp 1 to a hydrogen peroxide bleaching treatment in an alkaline aqueous medium under the following conditions: amount of hydrogen peroxide added for bleaching: 0.4% by weight/absolute dry weight of pulp; amount of sodium hydroxide added: 0.6% by weight/absolute dry weight of pulp; pulp concentration: 11%; reaction temperature: 60° C.; reaction time: 2 hrs.; pH; over 10.9.

Pulp 3. Conifer kraft pulp with a PC number of 2.0 obtained by the same treatments as with pulp 2 except that hydrogen peroxide and sodium hydroxide were used in amounts of 0.2% by weight and 0.3% by weight, respectively, per absolute dry weight of pulp.

Pulp 4. Conifer kraft pulp with a PC Number of 1.2 obtained by further subjecting pulp 1 to a sodium boron hydride bleaching treatment in an alkaline aqueous medium under the following conditions: amount of sodium boron hydride added for bleaching: 0.3% by weight/absolute dry weight of pulp; amount of sodium hydroxide: 0.1% by weight/absolute dry weight of pulp; pulp concentration: 4%; reaction temperature: 40°–70° C.; reaction time: 30 min.; pH: 8–10.

The stuff comprising 100 parts by weight of each said conifer kraft pulp was beaten to a degree (Canadian Standard Freeness) of 310 ml, and a web of 150 g/m$^2$ was made with the following blend. (The numerical values in the blend indicate parts by weight).

| Blend | |
|---|---|
| Pulp | 100 |
| Cationized starch | 2 |
| Anionic polyacrylamide | 0.5 |
| Sodium stearate | 0.5 |
| Aluminum sulfate | adjusted to pH 4.5 |
| Polyamidepolyamine-epichlorohydrin resin | 0.4 |

The obtained wet web was dried by a 110° C. heated plate. Then this web was impregnated with 20 g/m$^2$ of an impregnating solution of the following prescription and dried by a 120° C. hot-air constant-temperature dryer. (The numerical values in the prescription indicate parts by weight).

| Prescription | |
|---|---|
| Carboxy-modified polyvinyl alcohol | 3 |
| Diaminostilbenedisulfonate type optical whitening agent | 0.05 |
| Blue dye | 0.002 |
| Water was added to make the total amount | 100 |

The impregnated and dried web was subjected to a supercalender treatment under a linear pressure of 90 kg/cm to make a base web for resin-coated paper as well as a base web for comparative baryta paper.

Preparation of resin-coated paper

The base web was first subjected to a corona discharge treatment on its both sides and then the rear side was coated with a 1:1 mixture of a high-density polyethylene (density: 0.96 g/cm$^2$, melt index: 5) and a low-density polyethylene (density: 0.92 g/cm$^2$, melt index: 5) to a thickness of 30$\mu$ at a resin temperature of 330° C. by using a melt extrusion coater. Then the front side was coated with a low-density polyethylene (polyethylene density before addition of pigment: 0.92, melt index: 5) containing 8% of anatase type titanium oxide to a thickness of 30$\mu$ at a resin temperature of 330° C. Then the titanium oxide-containing polyethylene surface was subjected to a corona discharge treatment and thereafter coated with an emulsion defined below, followed by drying.

Preparation of comparative baryta paper

One side of said base web was coated with 40 g/m$^2$ of a baryta coating solution of the following prescription according to an air knife system and then dried. (The numerical values in the blend indicate parts by weight).

| Prescription | |
|---|---|
| Glossy baryta | 50 |
| Sodium hexamethaphosphate | 0.25 |
| 12% aqueous solution of formalin | 1.5 |
| Gelatin | 4 |
| By adding water to the composition | 100 |

Then the web was coated with the following emulsions respectively and dried.

Emulsion A

A neutralization-process silver halides photographic emulsion substantially consisting of the [1,0,0] planes, sulfur-sensitized to an optimum sensitivity, having a halogen composition of AgBr/AgCl=45/55 and an average particle size of 0.6$\mu$ and formulated by producing and dispersing 19.2 g (calcd. in terms of silver nitrate) of silver halides particles in 14.4 g of gelatin was added and dissolved in 420 g of an aqueous gelatin solution, then added with 6.4 ml of a 0.1% N,N-dimethylformamide solution of a sensitizing dye of the following formula (I):

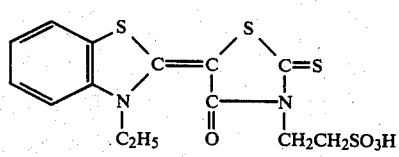

[I]

0.48 ml of a 1% methanol solution of 1-phenyl-5-mercaptotetrazole and 0.48 ml of a 1% methanol solution of 1-benzoylamino-2-phenyl-5-mercaptotriazole, and then further added with 10 ml of 10% sodium dodecylbenzenesulfonate, 20 ml of a 1% aqueous solution of a substituted diaminostilbenedisulfonate type fluorescent whitening agent and 16 ml of a 12% aqueous solution of formalin. Then the pH of the emulsion was adjusted to 4.6 by adding a pH adjustor and thereafter water was added to make the total amount 600 g.

Emulsion B

This emulsion was prepared in the same way as emulsion A except that 19.2 g (in terms of silver nitrate) of silver halides particles were produced and dispersed in 14.4 g of gelatin in the presence of $6\times10^{-6}$ g of potassium hexachlororhodanide (III).

Emulsion C

This emulsion was prepared in the same way as emulsion A except that 19.2 g (in terms of silver nitrate) of silver halides particles were produced and dispersed in 14.4 g of gelatin in the presence of $1.2\times10^{-4}$ g of potassium hexachloroiridate (III).

Emulsion D

This emulsion was prepared in the same way as emulsion A except that $2\times10^{-3}$ g of potassium chloride aurate (III) was added at the time of chemical aging in 19.2 g (in terms of silver nitrate) of silver halides emulsion and the emulsion was sensitized to an optimum degree of sensitivity by using both sulfur sensitization and gold sensitization means.

These emulsions were layer-coated, to a buildup of 75 g/m$^2$ (wet state), together with the below-mentioned protective layer, to said polyethylene-coated paper, baryta paper and polystyrene paper ("Printel" manufactured by Sekisui Chemical Co., Ltd.) which has been subjected to a corona discharge treatment on its front side, in the combinations shown in Table 1 below.

A solution was prepared by dissolving 30 g of gelating in 100 ml of water, then adding thereto 6.8 ml of 10% sodium dodecylbenzenesulfonate and 18 ml of a 12% aqueous solution of formalin, and then further adding water thereto so that the total amount would become 400 g, and this solution was applied on the emulsion layer as the protective layer to a coating weight of 40 g/m$^2$ (wet state).

Each of the thus coated and dried specimens was kept at normal temperature and normal humidity for 2 days and then at 50° C. and 60% RH for 7 days, and then it was exposed for sensitometry for 0.1 second, developed with a D-72 developer at 20° C. for 90 seconds, then stopped, fixed, washed with water and dried. The photographic properties of the obtained products were examined to determine the keeping quality.

The obtained results are shown in Table 1. As regards the sensitivity and tone, there were shown the relative sensitivity S and gradation $\gamma$ at reflection density D of 0.5.

TABLE 1

| | Photographic material construction | | | | Kept at normal temp. and normal humidity for 2 days. | | | Kept at 50° C. and 60% RH for 7 days | | |
|---|---|---|---|---|---|---|---|---|---|---|
| | Substrate | | | | | | | | | |
| | Type of substrate | Pulp used for base web: Type | Pulp used for base web: PC number | Type of emulsion | Relative sensitivity | Gradation | Fog density | Relative sensitivity | Gradation | Fog density |
| Com- | Poly- | Pulp | 3.7 | Emulsion A | 35.1 | 2.8 | 0.04 | 35.7 | 2.5 | 0.15 |

TABLE 1-continued

| | Photographic material construction | | | | Kept at normal temp. and normal humidity for 2 days. | | | Kept at 50° C. and 60% RH for 7 days | | |
|---|---|---|---|---|---|---|---|---|---|---|
| | Substrate | | | | | | | | | |
| | Type of substrate | Pulp used for base web Type | PC number | Type of emulsion | Relative sensitivity | Gradation | Fog density | Relative sensitivity | Gradation | Fog density |
| para- | ethylene | 1 | | Emulsion B | 33.6 | 4.3 | 0.04 | 35.1 | 3.2 | 0.12 |
| tive | coated | | | Emulsion C | 34.5 | 3.8 | 0.04 | 35.4 | 3.0 | 0.18 |
| Example | paper | | | Emulsion D | 36.5 | 2.6 | 0.06 | 37.1 | 2.2 | 0.26 |
| | Poly- | Pulp | 1.3 | Emulsion A | 35.0 | 2.8 | 0.04 | 35.2 | 2.7 | 0.05 |
| | ethylene | 2 | | Emulsion B | 33.6 | 4.3 | 0.04 | 33.9 | 4.1 | 0.05 |
| | | | | Emulsion C | 34.5 | 3.8 | 0.04 | 34.7 | 3.6 | 0.05 |
| | | | | Emulsion D | 36.5 | 2.6 | 0.06 | 36.7 | 2.4 | 0.08 |
| Exam- | Poly- | Pulp | 2.0 | Emulsion A | 35.1 | 2.8 | 0.04 | 35.5 | 2.6 | 0.07 |
| ples | ethylene | 3 | | Emulsion B | 33.6 | 4.3 | 0.04 | 34.5 | 3.7 | 0.06 |
| of | coated | | | Emulsion C | 34.5 | 3.8 | 0.04 | 35.0 | 3.3 | 0.08 |
| this | paper | | | Emulsion D | 36.5 | 2.6 | 0.06 | 36.9 | 2.3 | 0.12 |
| inven- | Poly- | Pulp | 1.2 | Emulsion A | 35.0 | 2.8 | 0.04 | 35.2 | 2.7 | 0.05 |
| tion | ethylene | 4 | | Emulsion B | 33.6 | 4.3 | 0.04 | 33.9 | 4.1 | 0.05 |
| | coated | | | Emulsion C | 34.5 | 3.8 | 0.04 | 34.7 | 3.6 | 0.05 |
| | paper | | | Emulsion D | 36.5 | 2.6 | 0.06 | 36.7 | 2.4 | 0.08 |
| Refer- | Baryta | Pulp | 3.7 | Emulsion A | 35.0 | 2.8 | 0.04 | 35.3 | 2.6 | 0.06 |
| ential | paper | 1 | | Emulsion B | 33.5 | 4.3 | 0.04 | 34.1 | 3.8 | 0.06 |
| Exam- | | | | Emulsion C | 34.4 | 3.8 | 0.04 | 34.8 | 3.4 | 0.06 |
| ples | | | | Emulsion D | 36.4 | 2.6 | 0.05 | 36.7 | 2.3 | 0.09 |
| | Baryta | Pulp | 1.3 | Emulsion A | 34.9 | 2.8 | 0.04 | 35.2 | 2.6 | 0.06 |
| | paper | 2 | | Emulsion B | 33.5 | 4.3 | 0.04 | 34.1 | 3.8 | 0.06 |
| | | | | Emulsion C | 34.4 | 3.8 | 0.04 | 34.8 | 3.4 | 0.06 |
| | | | | Emulsion D | 36.3 | 2.6 | 0.05 | 36.6 | 2.4 | 0.09 |
| | Poly | | | Emulsion A | 35.1 | 2.8 | 0.04 | 35.4 | 2.6 | 0.06 |
| | styrene | | | Emulsion B | 33.6 | 4.3 | 0.04 | 35.1 | 3.8 | 0.06 |
| | paper | | | Emulsion C | 34.5 | 3.8 | 0.04 | 34.9 | 3.4 | 0.06 |
| | | | | Emulsion D | 36.5 | 2.6 | 0.06 | 36.8 | 2.3 | 0.10 |

According to the results shown in Table 1, it is noted that the keeping quality of the silver halides photographic emulsion layer provided on baryta paper or polystyrene paper is not so bad, but in the combination of the base paper of Comparative Example mainly composed of natural pulp and having a PC number of 3.7 and a specific silver halides emulsion provided on the polyethylene-coated paper comprising said base web, that is, an emulsion layer produced by incorporating a water-soluble rhodium compound or a water-soluble iridium compound at the time of formation and dispersion of silver halides, the keeping quality, particularly that relating to tone and sensitivity, of said emulsion layer is very poor and there is also noted a high tendency to fogging.

In contrast with this, any of the emulsion layers provided on the polyethylene-coated paper using as substrate a web principally composed of natural pulp and having a PC number of less than 2.0 according to this invention shows excellent keeping quality and is also capable of well controlling increase of sensitivity and softening of tone as well as fogging tendency. It is also noted that a higher keeping quality improving effect is obtained by using natural pulp with a PC number of less than 1.5 for the base web.

EXAMPLE 2

A polyethylene-coated paper provided with silver halides emulsion layer was prepared in the same way as Example 1 except for use of Emulsion B by using a natural pulp mixture consisting of 29.1 parts by weight of pulp 1 and 70.9 parts by weight of pulp 2. The PC number of said pulp mixtures was 2.0. The photographic properties of this paper, as determined under the same conditions as in Example 1, were not much different from those obtained by using pulp 3 in Example 1, as shown below.

| Kept at normal temp. and normal humidity for 2 days | | | Kept at 50° C. and 60% RH for 7 days | | |
|---|---|---|---|---|---|
| Relative sensitivity | Gradation | Fog density | Relative sensitivity | Gradation | Fog density |
| 33.6 | 4.3 | 0.04 | 34.5 | 3.6 | 0.06 |

EXAMPLE 3

By using as substrate a polyethylene-coated paper comprising as base a web using pulp with a PC number of less than 1.0 and by following the same procedure as Example 1 except for use of an emulsion prepared similarly to emulsion B but by adding potassium hexachlororhodanide (III) 10 minutes after formation of silver halide, there was obtained a silver halides photographic material with hard tone and excellent keeping quality.

EXAMPLE 4

Two types of polyethylene-coated paper were prepared after the manner of Example 1 by using as base the webs composed of pulp 1 for control and pulp 2 of this invention, respectively. Then the polyethylene side containing titanium oxide was subjected to a corona discharge treatment and then coated with the below-specified emulsions in the combinations shown in Table 2, followed by drying.

Blue sensitive emulsion E

A total ammonia process silver halides photographic emulsion sulfur-sensitized to an optimum sensitivity, having a halogen composition of AgBr/AgCl=95/5 and an average particle size of 0.8μ and produced by forming and dispersing 9.6 g (in terms of silver nitrate) of silver halides particles in 4.8 g of gelatin in the presence of $1.0\times10^{-5}$ g of potassium hexachloroiridate (III) was added and dissolved in 240 g of a 4% aqueous gelatin solution and then added with 9.6 ml of a 0.1% N,N-dimethylformamide solution of a blue sensitizing dye of the following formula (II):

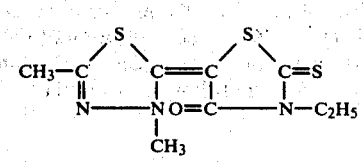
[II]

and 1.4 ml of a 1% alkaline aqueous solution of 4-hydroxy-6-methyl-1,3,3a,7-tetraazaindene. The mixture was then further added with a dispersion prepared by dissolving 8 g of an yellow coupler of the following formula (III):

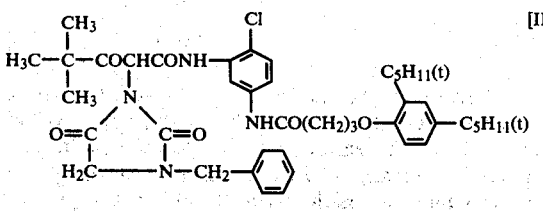
[III]

in 16 ml of ethyl acetate and 4 ml of dibutyl phthalate and then adding and dispersing this solution in 140 g of a 10% gelatin aqueous solution added with 200 ml of a 5% sodium dodecylbenzene-sulfonate solution, and 1.4 ml of a 10% methanol solution of a compound of the following formula (IV):

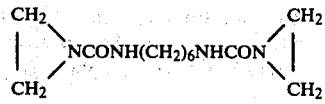
[IV]

and 7 ml of a 2% aqueous solution of a compound of the following formula (V):

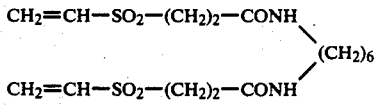
[V]

Thereafter, pH of the emulsion was adjusted to 6.4 and then water was added so that the total amount would become 800 g.

Blue sensitive emulsion F

This emulsion was prepared in the same way as preparation of the blue sensitive emulsion E except for extra addition of 1.4 ml of a 1% alkaline aqueous solution of 4-hydroxy-6-methyl-1,3,3a,7-tetraazaindene used as antifogging agent or stabilizer and further addition of 0.85 ml of a 0.1% methanol solution of 1-phenyl-5-mercaptotetrazole and 1.4 ml of a 0.1% methanol solution of 1-ethyl-2-mercaptobenzimidazole.

These emulsions were applied in superposition, to a buildup of 50 g/m² (wet state), on said polyethylene-coated paper together with the protective layer prepared in the manner described below.

1 Gram of 2,5-di-tert-octylhydroquinone was dissolved in 2 ml of ethyl acetate and 1 ml of tricresyl phosphate and then added and dispersed in 100 g of a 10% gelatin solution added with 12.5 ml of a 5% aqueous solution of sodium dodecylbenzenesulfonate. This dispersion was added into 250 g of a 10% gelatin solution, then added with 3.5 ml of a 10% methanol solution of the compound (IV) and 17.5 ml of a 2% aqueous solution of the compound (V) and then further added with water so that the total amount would become 500 g, and this solution was applied together with said blue sensitive emulsion layers as the protective layer with a coating weight of 20 g/m² (wet state).

Also, an acid process silver halides photographic emulsion constituted substantially from the [1,0,0] planes—which has been sulfur-sensitized to an optimum sensitivity, had a halogen composition of AgBr/AgCl=95/5 and an average particle size of 0.4μ and was produced by forming and dispersing 9.6 g (in terms of silver nitrate) of silver halides particles in 4.8 g of gelatin in the presence of $3\times10^{-5}$ g of potassium hexachloroiridate (III)—was added and dissolved in 240 g of a 4% gelatin solution and then added with 9.6 ml of a 0.1% N,N-dimethylformamide solution of a green sensitizing dye of the following formula (VI);

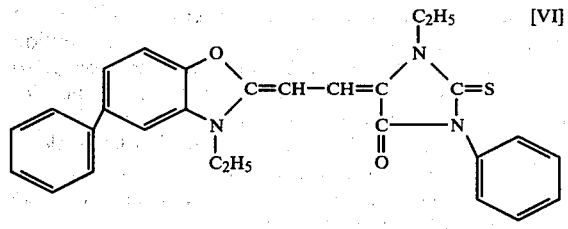
[VI]

and 1.4 ml of a 1% alkaline aqueous solution of 4-hydroxy-6-methyl-1,3,3a,7-tetraazaindene. This emulsion was further added with a dispersion prepared by dissolving 8 g of a magenta coupler of the following formula (VII):

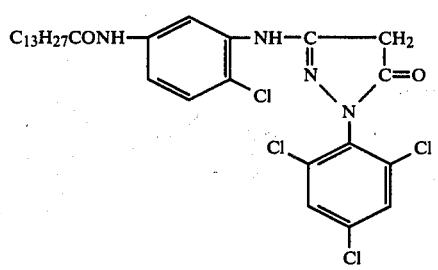
[VII]

and 0.24 g of 2,5-di-tert-octylhydroquinone in 16 ml of ethyl acetate and 8 ml of dibutyl phthalate and adding and dispersing this solution in 140 g of a 10% gelatin solution added with 20 ml of a 5% aqueous solution of sodium dodecylbenzenesulfonate, 1.4 ml of a 10% methanol solution of the compound (IV) and 14 ml of a 2% aqueous solution of the compound (V). Thereafter, pH of the emulsion was adjusted to 6.4 and then water was added so that the total amount would become 800 g. This emulsion was coated, to a buildup of 50 g/m$^2$ (wet state), on said blue sensitive emulsoin layer along with the following ultraviolet absorbing layer.

6.4 Grams of an ultraviolet absorbing agent of the following formula (VIII):

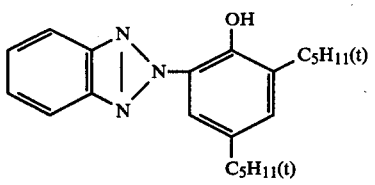

[VIII]

was dissolved in 12.8 ml of ethyl acetate and 6.4 ml of di-normalnonyl phthalate and then added and dispersed in 140 g of a 10% gelatin solution added with 20 ml of a 5% aqueous solution of dodecylbenzenesulfonate, and this dispersion was added into 100 g of 10% gelatin, then added with 2.4 ml of a 10% methanol solution of the compound (IV) and 18 ml of a 2% aqueous solution of the compound (V) and further added with water so that the total amount would become 320 g, and this solution was coated, to a coating weight of 20 g/m$^2$ (wet state), on said blue sensitive emulsion layer along with said green sensitive emulsion layer such that the ultraviolet absorbing layer would be placed above said green sensitive emulsion layer.

Further, an emulsion, which as been prepared in the same way as the green sensitive emulsion and which has been chemically aged, was added with 9.6 ml of a 0.01% N,N-dimethylformamide solution of a red sensitizing dye of the following formula (IX):

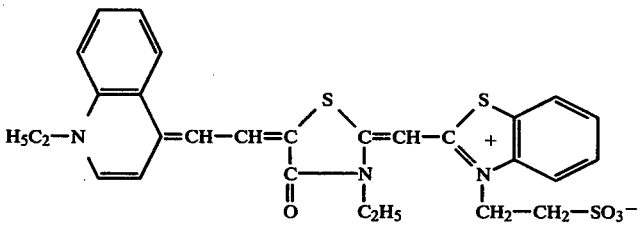

[IX]

and 1.4 ml of a 1% alkaline aqueous solution of 4-hydroxy-6-methyl-1,3,3a,7-tetraazaindene. This solution was further added with a dispersion prepared by dissolving 4.8 g of a cyan coupler of the following formula (X):

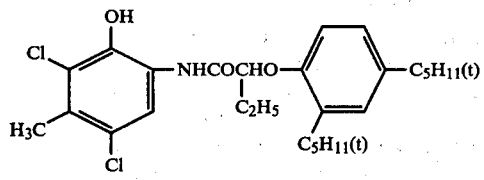

[X]

and 0.24 g of 2,5-di-tert-octylhydroquinone in 9.6 ml of ethyl acetate and 4.8 ml of dibutyl phthalate and then adding and dispersing this solution in 140 g of a 10% gelatin solution added with 20 ml of a 5% aqueous solution of sodium dodecylbenzenesulfonate, and was also added with 1.4 ml of a 10% methanol solution of the compound (IV), a 2% aqueous solution of the compound (V) and 16 ml of a 1% aqueous solution of a sharpness improver of the following formula (XI):

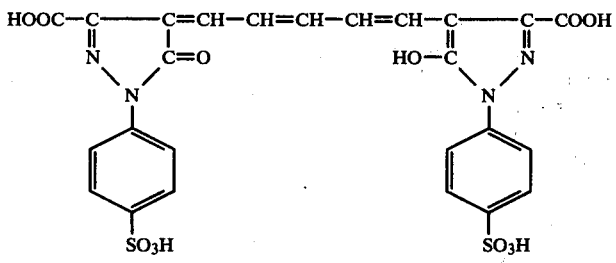

[XI]

Thereafter, pH of the emulsion was adjusted to 6.4 and then water was added so that the total amount would become 800 g. This emulsion was coated, to a buildup of 50 g/m$^2$ (wet state), on the coating layer of said green sensitive emulsion together with the below-said protective layer of a red sensitive emulsion.

12.5 Milliliters of a 10% aqueous solution of sodium dodecylbenzenesulfonate, 3.5 ml of a 10% methanol solution of the compound (IV) and 35 ml of a 2% aqueous solution of the compound (V) were added into 350 g of a 10% gelatin solution, and then water was added so that the total amount would become 500 g. This solution was applied together with the red sensitive emulsion layer as a protective layer thereof with a coating weight of 20 g/m$^2$ (wet state). The thus coated and dried multi-layer silver halides color photographic material has a blue sensitive emulsion layer, a green sensitive emulsion layer and a red sensitive emulsion layer arranged in that order upwardly on the polyethylene-coated paper used as substrate.

The coated specimens were kept at 35° C. and normal humidity for 3 days and then at 50° C. and 60% RH for 7 days, then exposed for sensitometry for 0.3 second and then subjected to color development (33°, 3 min. and 30 sec.), bleaching and fixing (1 min. and 30 sec.), washing with water (3 min.) and drying, and then the photographic properties were examined to determine the keeping quality.

The respective treating solutions used were of the following compositions.

| Color developer | |
|---|---|
| Sodium carbonate (monohydrate) | 46.0 g |
| Anhydrous sodium sulfite | 2.0 g |
| Potassium bromide | 0.5 g |
| CD-III | 4.5 g |
| Sodium hexamethanoate | 0.5 g |
| Hydroxylamine sulfate | 2.0 g |
| Fluorescent brightening agent | 0.5 g |
| Benzyl alcohol | 12 ml |
| Diethylene glycol | 10 ml |

Water was added so that the total amount would become 1 liter and pH of the solution was adjusted to 10.2 by adding sodium hydroxide.

| Bleaching and fixing solution | |
|---|---|
| Ferric complex salt of ethylenediaminetetraacetic acid | 56 g |
| Disodium salt of ethylenediaminetetraacetic acid | 2 g |
| Ammonium thiosulfate | 60 g |
| Anhydrous sodium sulfite | 20 g |
| Sodium bisulfite | 5 g |

-continued

| Bleaching and fixing solution | |
|---|---|
| Disodium phosphate | 12 g |

Water was added so that the total amount would become 1 liter.

The obtained results are shown in Table 2 and Table 3. The properties shown in Table 2 are those of the yellow images after color development and desilverization, and the properties shown in Table 3 are those of the magenta images and cyan images after color development and desilverization. As for the sensitivity and tone, there were shown the relative sensitivity S and relative exposure latitude L (the smaller the figure, the harder is the tone; each value being the logalithmic difference of exposure that gives D=0.21 and D=0.75) at the reflection density D of 0.5 of each image after color development and desilverization.

The development promotiveness of the specimens was evaluated by comparing the photographic properties of the specimens which were color developed in standard development time (3 min. and 30 sec.) and the photographic properties of the specimens which were color developed in a shorter time (2 min.) (actually, deducting the property value of the latter from that of the former).

TABLE 2

| | | | Kept at 35° C. in normal humidity for 3 days | | | | | | Kept at 50° C. in 60% RH for 7 days | | |
|---|---|---|---|---|---|---|---|---|---|---|---|
| | | | | | | | Development promotiveness (Note 2) | | | | |
| | Type of pulp used for the base web of polyethylene-coated paper | Type of blue sensitive emulsion coated | Relative sensitivity | Relative exposure latitude | Fog density | Desilverization speed (Note 1) | Relative sensitivity difference | Relative exposure latitude difference | Relative sensitivity | Relative exposure latitude | Fog density |
| Comparative Examples | Pulp 1 (PC number 3.7) | Blue sensitive emulsion E | 43.9 | 0.51 | 0.03 | 60 sec. | 0.9 | −0.05 | 44.6 | 0.56 | 0.12 |
| | Pulp 1 (PC number 3.7) | Blue sensitive emulsion F | 43.0 | 0.54 | 0.03 | 95 sec. | 1.3 | −0.09 | 42.9 | 0.58 | 0.03 |
| Example of this invention | Pulp 2 (PC number 1.3) | Blue sensitive emulsion E | 43.9 | 0.50 | 0.03 | 60 sec. | 0.9 | −0.04 | 44.0 | 0.51 | 0.03 |

(Note 1)
The smaller the figure, the faster is the desilverization speed. Each figure is the time required till the silver image in the color developed image is bleached and becomes indiscriminatable visually.
(Note 2)
In both "relative sensitivity difference" and "relative exposure latitude difference", the closer is the value to zero, the greater is the development promotiveness.

TABLE 3

| | | | Kept at 35° C. and normal humidity for 3 days | | | Kept at 50° C. and 60% RH for 7 days | | |
|---|---|---|---|---|---|---|---|---|
| | Type of pulp used for base of polyethylene coated paper | Type of emulsion | Relative sensitivity | Relative exposure latitude | Fog density | Relative sensitivity | Relative exposure latitude | Fog density |
| Comparative Example | Pulp 1 (PC number 3.7) | Green sensitive emulsion layer | 38.6 | 0.56 | 0.04 | 39.0 | 0.64 | 0.08 |
| Example of this invention | Pulp 2 (PC number 1.3) | Green sensitive emulsion layer | 38.6 | 0.55 | 0.04 | 38.7 | 0.58 | 0.04 |

TABLE 3-continued

| | Type of pulp used for base of polyethylene coated paper | Type of emulsion | Kept at 35° C. and normal humidity for 3 days | | | Kept at 50° C. and 60% RH for 7 days | | |
|---|---|---|---|---|---|---|---|---|
| | | | Relative sensitivity | Relative exposure latitude | Fog density | Relative sensitivity | Relative exposure latitude | Fog density |
| Comparative Example | Pulp 1 (PC number 3.7) | Red sensitive emulsion layer | 37.5 | 0.45 | 0.04 | 37.2 | 0.52 | 0.10 |
| Example of this invention | Pulp 2 (PC number 1.3) | Red sensitive emulsion layer | 37.5 | 0.45 | 0.04 | 37.3 | 0.48 | 0.04 |

As seen from Table 2, the blue sensitive emulsion coated on the polyethylene-coated paper of this invention using as substrate a web composed of pulp having a PC number of less than 2 is amazingly limited in change of sensitivity and tone after preservation without deterioration of the desilverizing and development promoting effects and is also markedly suppressed in fogging tendency and excellent in keeping quality. On the other hand, as noted from the table, the blue sensitive emulsion coated on the polyethylene-coated paper of the comparative examples undergoes noticeable change in sensitivity and tone and also shows a high tendency to fogging. In the case of the blue sensitive emulsion added with an antifogging agent or stabilizer, although fogging is controlled, the desilverizing and development promoting effects are deteriorated.

It is also seen from Table 3 that the green sensitive emulsion and red sensitive emulsion coated on the polyethylene coated paper of this invention, as compared with those coated on the polyethylene-coated paper of the comparative examples, are noticeably controlled in increase of sensitivity and softening of tone and also markedly suppressed in fogging tendency and excellent in keeping quality.

What is claimed is:

1. A silver halide photographic material in which a photographic layer composed of at least one silver halide emulsion layer is provided on a substrate prepared by coating a base web principally composed of natural pulp with a film-forming resin, wherein the silver halide photographic emulsion layer is one which has been produced by incorporating at least one of the water soluble rhodium compounds or water soluble iridium compounds at the time of formation and dispersion or at the time of physical aging of the silver halide or the silver halide photographic emulsion layer contains a water soluble gold compound; the natural pulp or a mixture of two or more different types of natural pulp used for the base web of said substrate is one which has been produced by performing an additional bleaching treatment with a peroxide or a boron hydride compound in an alkaline state after the conventional pump bleaching treatment and has a PC number of 2.0 or less, said PC number being defined by the following formula:

$$P = 100\left\{\frac{(1-R)^2}{2R} - \frac{(1-Ro)^2}{2Ro}\right\}$$

wherein Ro=brightness (%)×(1)/(100) before the fading treatment, R=brightness (%)×1/100 after 18-hour fading treatment at 85° C. and 95% RH, and P is the post color (PC) number which indicates the degree (nondimensional number) of fading.

2. A silver halide photographic material according to claim 1, wherein the natural pulp or a mixture of two or more different types of natural pulp used for the base web of said substrate has a PC number of 1.5 or less.

3. A silver halide photographic material according to claim 1, wherein the additional bleaching treatment is carried out by using a peroxide in an alkaline aqueous medium.

4. A silver halide photographic material according to claim 3, wherein the peroxide is hydrogen peroxide.

5. A silver halide photographic material according to claim 1, wherein the natural pulp used for the base web of said substrate is one which has been bleached by using a boron hydride compound in an alkaline state.

6. A silver halide photographic material according to claim 1, wherein the additional bleaching treatment is carried out at a pH of 8 to 11.

7. A silver halide photographic material according to claim 1, wherein the conventional bleaching treatment is one selected from chlorine or alkali treatment, extraction or refining treatment, hypochlorite bleaching, chlorine dioxide bleaching and a combination thereof.

8. A silver halide photographic material according to claim 7, wherein an alkali treatment, alkali extraction or alkali refining is carried out after the additional bleaching treatment using a peroxide or a boron hydride compound in an alkaline state.

9. A silver halide photographic material according to claim 1, wherein the film-forming resin is a polyethylene resin.

10. A silver halide photographic material according to claim 1, wherein the silver halide photographic emulsion layer is one which has been produced by incorporating at least one of the water-soluble rhodium compounds or water-soluble iridium compounds at the time of formation and dispersion or at the time of the physical aging of silver halide.

11. A silver halide photographic material according to claim 1, wherein the silver halide emulsion layer contains a water-soluble gold compound.

* * * * *